US009108701B1

(12) United States Patent
Garner

(10) Patent No.: US 9,108,701 B1
(45) Date of Patent: Aug. 18, 2015

(54) SHALLOW WATER BOAT

(71) Applicant: Jeff Alan Garner, Corpus Christi, TX (US)

(72) Inventor: Jeff Alan Garner, Corpus Christi, TX (US)

( * ) Notice: Subject to any disclaimer, the term of this patent is extended or adjusted under 35 U.S.C. 154(b) by 97 days.

(21) Appl. No.: 13/938,123

(22) Filed: Jul. 9, 2013

Related U.S. Application Data

(60) Provisional application No. 61/669,988, filed on Jul. 10, 2012.

(51) Int. Cl.

| | |
|---|---|
| ***B63B 1/16*** | (2006.01) |
| ***B63B 1/32*** | (2006.01) |
| *B63B 1/20* | (2006.01) |

(52) U.S. Cl.
CPC ..... *B63B 1/32* (2013.01); *B63B 2001/201* (2013.01)

(58) Field of Classification Search
CPC ..... B63B 2001/201; B63B 2001/202
USPC ..... 114/290, 288, 289
See application file for complete search history.

(56) References Cited

U.S. PATENT DOCUMENTS 4,907,520 A * 3/1990 Pipkorn ..... 114/61.3

* cited by examiner

*Primary Examiner* — S. Joseph Morano
*Assistant Examiner* — Andrew Polay
(74) *Attorney, Agent, or Firm* — Plager Schack LLP

(57) ABSTRACT

A shallow water boat is configured to provide increased stability and turning ability at high speeds. The shallow water boat has a hull including a hull bottom. The hull bottom includes a port raised tunnel and a starboard raised tunnel which can channel water from fore to aft. The hull bottom also includes a port slightly concave surface outboard the port raised tunnel and a starboard slightly concave surface outboard the starboard raised tunnel. The slightly concave surfaces trap air which would otherwise flow outward creating a laminar flow condition which increases stability and the turning ability at high speeds.

3 Claims, 2 Drawing Sheets

SHALLOW WATER BOAT

RELATED APPLICATION

This application claims priority to provisional patent application U.S. Ser. No. 61/669,988 filed on Jul. 10, 2012, the entire contents of which is herein incorporated by reference.

BACKGROUND

The embodiments herein relate generally to design of watercraft and related vessels.

Prior to embodiments of the disclosed invention, flat bottomed boats that ran in very shallow displayed negative characteristics like poor handling, slow acceleration along with poor handling in rough water. Prior art solutions to this problem involve a completely flat bottom with a tunnel or a slight deadrise with a tunnel. However, these devices can only feed a limited amount water resulting in very gradual acceleration. Others can feed water but do so at the expense of increased drag through a condition known as "tunnel suck". This is caused by increased turbulent flow of water in the tunnel along with greater surface area increasing drag. Embodiments of the disclosed invention solve these problems.

In particular, this could be valuable to flats fishermen who want to run their boats very shallow in the fishing grounds but want to get to those fishing grounds as fast and efficiently as possible. In the case of tournament fishermen and guides their livelihood depends on the ability to be the first to start fishing without sacrificing speed and handling.

SUMMARY

A shallow water boat is configured to provide increased stability and turning ability at high speeds. The shallow water boat has a hull including a hull bottom. The hull bottom includes a port raised tunnel and a starboard raised tunnel which can channel water from fore to aft. The hull bottom also includes a port slightly concave surface outboard the port raised tunnel and a starboard slightly concave surface outboard the starboard raised tunnel. The slightly concave surfaces trap air which would otherwise flow outward creating a laminar flow condition which increases stability and the turning ability at high speeds.

In some embodiments, the hull bottom also includes a port reverse deadrise immediately adjacent to the port slightly concave surface and a starboard reverse deadrise immediately adjacent to the starboard slightly concave surface. The port reverse deadrise and the starboard reverse deadrise feed the water to the port raised tunnel and the starboard raised tunnel to reduce drag of the hull bottom.

In some embodiments, the port slightly concave surface further comprises a port outboard chine attached outboard a port reverse chine. The starboard slightly concave surface further comprises a starboard outboard chine attached outboard a starboard reverse chine.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
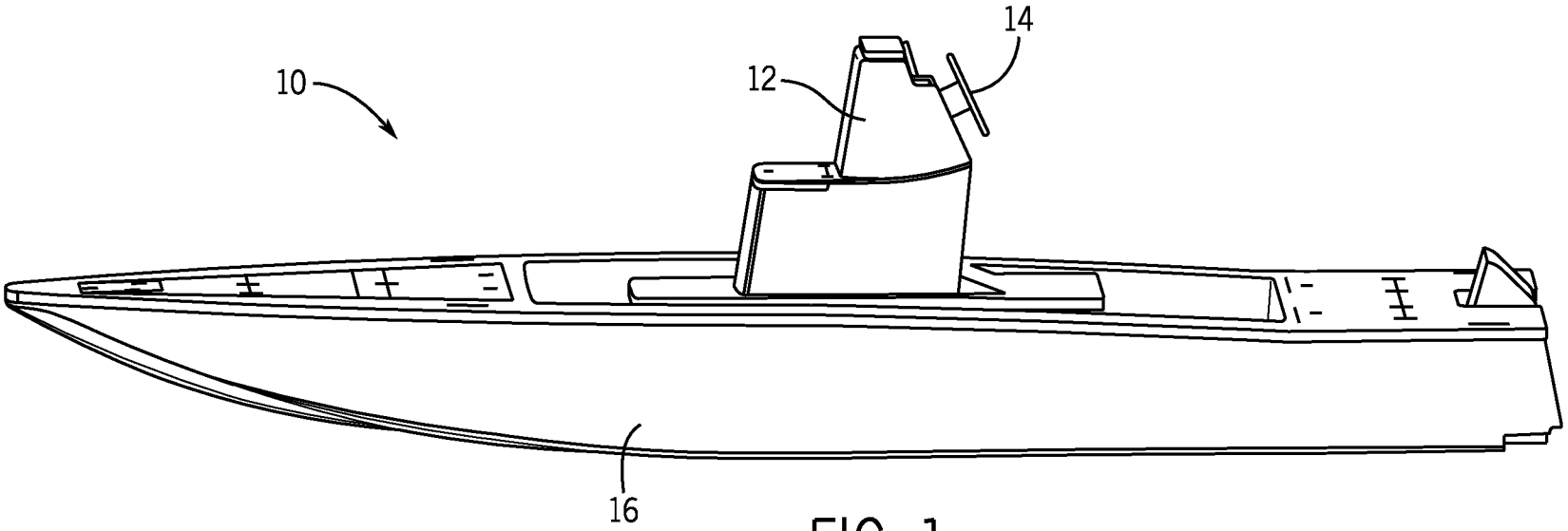
FIG. 1 is a side elevation view.

By way of example, and referring to FIG. 1, one embodiment of boat 10 comprises control unit 12 mechanically coupled to steering wheel 14 and hull 16. Boat 10 is designed to operate in shallow water, which is water of about two inches in depth which is calm and flat. Hull 16 is shown in more detail in FIG. 2, FIG. 3 and FIG. 4 below.

Figure 2:
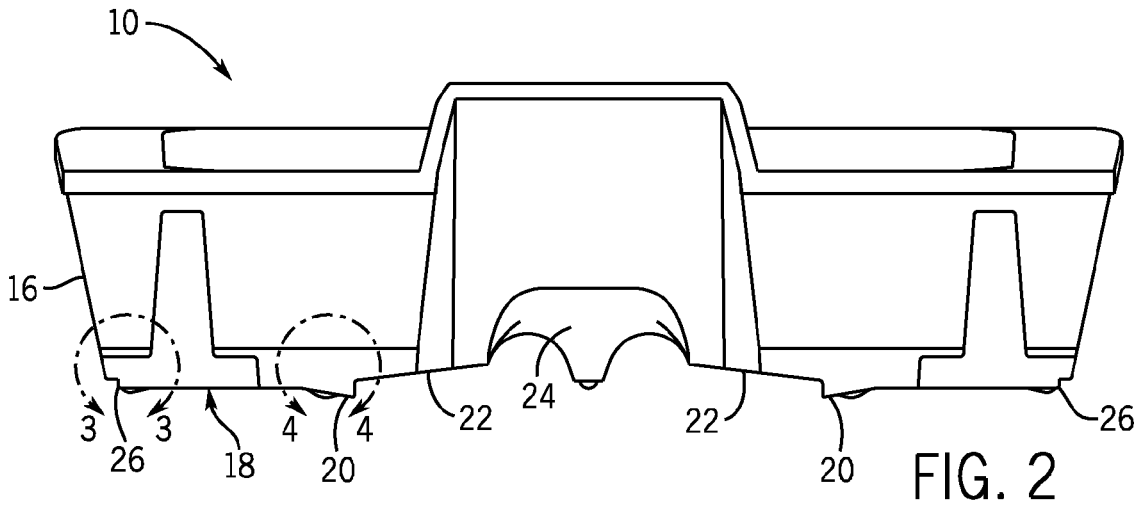
FIG. 2 is a rear elevation view.

Turning to FIG. 2, hull 16 should have an airfoil design angling slightly downward and inboard from top to bottom. Hull 16 comprises hull bottom 18. Hull bottom 18 contains port outboard chine 26 and starboard outboard chine 26 as shown in more detail in FIG. 3. Hull bottom 18 further comprises port reverse chine 20 and starboard reverse chine 20 which are shown in more detail in FIG. 4.

Hull bottom 18 further comprises port dead rise 22 which angles upward and inboard from port reverse chine 20 to port raised tunnel 24. Likewise, hull bottom 18 further comprises starboard dead rise 22 which angles upward and inboard from starboard reverse chine 20 to starboard raised tunnel 24.

Figure 3:
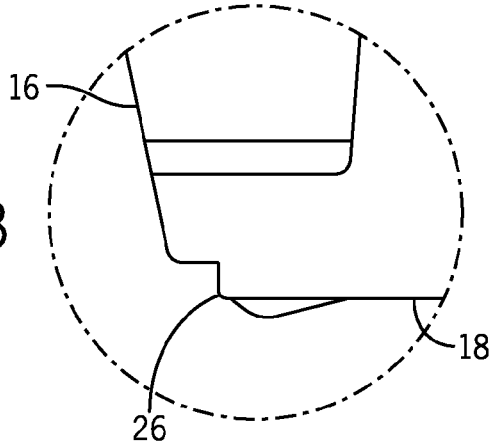
FIG. 3 is a detail elevation view indicated by line 3-3 of FIG. 2.

FIG. 3 shows port outboard chine 26 in more detail. Port outboard chine 26 extends outward and downward from hull bottom 18 and the rolls upward and outboard. At higher speeds, hull bottom 18 rises above the water and air, would normally be channeled outward as boat 10 moved forward. This destabilizes boat 10. However, port outboard chine 26 and starboard outboard chine 26 prevent this. Instead, as hull bottom 18 channels air toward the stern of boat 10 promoting stability and enabling high speed turning.

Figure 4:
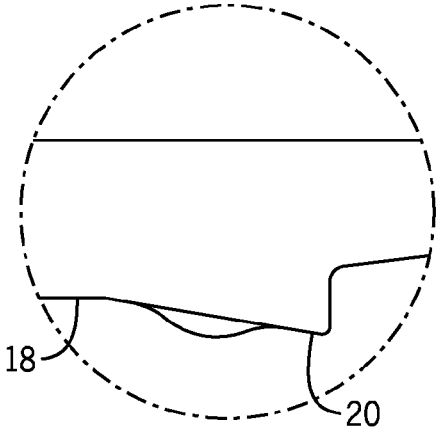
FIG. 4 is another detail elevation view indicated by line 4-4 of FIG. 2.

FIG. 4 shows port reverse chine 20 in more detail. Port reverse chine 20 extends inboard and downward from hull bottom 18 and then upward and inboard to port deadrise 22. Starboard reverse chine 20 is formed likewise.

As boat 10 travels forward, port reverse chine 20 and starboard reverse chine 20 trap water from flowing outboard from a centerline on hull bottom 18. Rather port reverse deadrise 22 and starboard reverse deadrise 22 feed the water to port raised tunnel 24 and starboard raised tunnel 24 without the increase in drag realized by the prior art because the turbulent water flow does not extend outward to the edge of hull bottom 18.

As speed increases, each reverse chine 20 and each outboard chine 26 form a slightly concave surface on hull bottom 18 that traps air which would otherwise flow outward is prevented from doing so by the slightly concave surface creating a laminar flow condition and aerating the running surfaces. As speed further increases, hull bottom 18 is further lifted up from the water, but each reverse chine 20 continues to direct a turbulent flow of water toward the raised tunnels 24 further reducing drag. By increasing the surface area of hull bottom 18 which is subjected to laminar flow and reducing the surface area of water subjected to turbulent flow, the slightly concave surfaces provide directional control without sacrificing shallow water draft.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shallow water boat, configured to provide stability and turning ability at increasing speeds, the shallow water boat comprising:

a hull further comprising a hull bottom;

wherein, the hull bottom further comprising a port raised tunnel and a starboard raised tunnel configured to channel water from fore to aft;

wherein the hull bottom further comprises a port concave surface outboard the port raised tunnel and a starboard concave surface outboard the starboard raised tunnel;

wherein the concave surfaces trap air moving from inboard to outboard, which would otherwise flow outboard creating a laminar flow condition which provides stability and the turning ability at increasing speeds;

the port concave surface further comprises a port outboard chine attached outboard a port reverse chine and extending downward from the port concave surface;

the port outboard chine is joined to a port outboard right angle cutout extending inboard toward the port concave surface;

the starboard concave surface further comprises a starboard outboard chine attached outboard a starboard reverse chine and extending downward from the starboard concave surface; and the starboard outboard chine is joined to a starboard outboard right angle cutout extending inboard toward the starboard concave surface.

2. The shallow water boat of claim 1, wherein the hull bottom further comprises a port reverse deadrise immediately adjacent to the port slightly concave surface; and a starboard reverse deadrise immediately adjacent to the starboard slightly concave surface;

wherein the port reverse deadrise and the starboard reverse deadrise feed the water to the port raised tunnel and the starboard raised tunnel to reduce drag of the hull bottom.

3. The shallow water boat of claim 1, the port slightly concave surface further comprises a port outboard chine attached outboard a port reverse chine; and the starboard slightly concave surface further comprises a starboard outboard chine attached outboard a starboard reverse chine.

* * * * *